US005938967A

United States Patent [19]

Reo et al.

[11] Patent Number: 5,938,967

[45] Date of Patent: Aug. 17, 1999

[54] CASING STRUCTURE OF A MICROWAVE OVEN

[75] Inventors: Wha Gyu Reo; Jong Hoi An; Yun Ic Hwang, all of Kyungki-do, Rep. of Korea

[73] Assignee: Samsung Electronics Co., Ltd., Suwon-City, Kyungki-Do, Rep. of Korea

[21] Appl. No.: 08/842,018

[22] Filed: Apr. 23, 1997

[30] Foreign Application Priority Data

| | | | |
|---|---|---|---|
| Apr. 23, 1996 | [KR] | Rep. of Korea | 96-9020 |
| Jul. 4, 1996 | [KR] | Rep. of Korea | 96-27133 |
| Feb. 10, 1997 | [KR] | Rep. of Korea | 97-3860 |
| Mar. 19, 1997 | [KR] | Rep. of Korea | 97-9276 |

[51] Int. Cl.[6] ..... H05B 6/80; F24C 15/08

[52] U.S. Cl. ..... 219/756; 126/275 E

[58] Field of Search ..... 219/756, 757, 219/391; 126/275 R, 275 E

[56] References Cited

U.S. PATENT DOCUMENTS

| | | | |
|---|---|---|---|
| 3,867,605 | 2/1975 | Yee | 219/756 |
| 4,282,416 | 8/1981 | White | 219/756 |
| 4,609,801 | 9/1986 | Spencer et al. | 219/756 |

FOREIGN PATENT DOCUMENTS

| | | |
|---|---|---|
| 0 394 978 | 10/1990 | European Pat. Off. . |
| 0 743 491 | 11/1996 | European Pat. Off. . |
| 93/22593 | 11/1993 | WIPO . |

*Primary Examiner*—Philip H. Leung
*Attorney, Agent, or Firm*—Burns, Doane, Swecker & Mathis, L.L.P.

[57] ABSTRACT

A microwave oven includes inner and outer casings, the inner casing forming a cooking chamber, and the outer chamber encompassing a portion of the inner casing. The inner casing includes a front plate which forms an access opening for the cooking chamber. The front plate fits into the outer casing and includes flanges extending along an inside surface of the outer casing. The outer casing includes bent portions which form slits into which the flanges of the front plate are inserted. The inner and outer casings form a stop structure which positions the inner and outer casings in a predetermined relationship. The stop structure comprises tabs formed on the bent portions, the tabs abutted by the flanges of the inner casing. Alternatively, the stop structure could be formed by bent ends of the flanges which engage respective ends of the bent portions.

5 Claims, 7 Drawing Sheets

CASING STRUCTURE OF A MICROWAVE OVEN

BACKGROUND OF THE INVENTION

The present invention relates to a microwave oven, and more particularly, to an interconnection between inner and outer casings of the oven.

A microwave oven is cooking equipment wherein microwaves generated by a magnetron are radiated into a cooking chamber for inductively heating food in the cooking chamber.

FIG. 8 is an exploded perspective view of a conventional microwave oven. As shown in FIG. 8, the microwave oven includes an outer casing 110 defining an outer appearance of the oven, and an inner casing 120 forming a cavity 130. In the outer casing 110, an upper plate portion 111 and two sidewall portions 112 and 113 are integrally formed in an inverted U-shaped form. The inner casing 120 has a front plate 121, a rear plate 123 and a bottom plate 125 which respectively form a front opening, a rear opening and a bottom opening.

The outer periphery of the front plate 121 includes top and side edges which have bent flanges 122 formed thereon. The inner casing 120 includes a cavity casing 126 which is connected with the front plate 121, the rear plate 123 and the bottom plate 125 to form therewith a cooking chamber 130. A door 133 is connected with the front plate 121, which rotatably opens and closes the front opening, which constitutes an access opening of the cooking chamber 130. The door 133 is mounted by means of hinges 131 which are disposed on the upper and lower ends of the left side of the front plate 121 of the inner casing 120. Further, a control panel 135 having a plurality of manipulation buttons 136 for controlling the microwave oven is connected to the right side of the front plate 121.

A component chamber 140 is formed between the outer casing 110 and the cavity casing 126 of the inner casing 120. A magnetron 141, a high-voltage transformer 142 for inducing high voltage, and a high-voltage capacitor 143 for applying a high voltage are installed in the component chamber 140. A cooling fan 144 for blowing air toward the magnetron 141 is installed on the rear plate 123 of the component chamber 140.

Screw connection holes (not shown) are formed along the upper, left and right edges of the rear plate 123. The front edges of the upper plate portion 111 and both sidewall portions 112 and 113 are bent to form a Z-shaped stopper portion 115 in the form of an internal strip. A rear edge of each of the plate portions 111, 112, 113 is defined by a bent portion 118 which is bent perpendicularly relative to the respective plate portion. Screw connection holes 119 are formed in the bent portions 118.

During assembly of the inner and outer casings, the stopper portions 115 of the outer casing 110 receive respective flange portions 122 of the front plate 121, as shown in FIG. 8A. At the same time, the bent portions 118 formed along the rear edge of the outer casing 110 will engage the edge of the rear plate 123 of the inner casing 120, and are tightly fixed thereto by screws inserted into the screw connection holes 119.

It is difficult to achieve and retain a precise orientation between the front plate 121 and the outer casing. Due to limits in the amount of accuracy that can be achieved in the process of bending-over the front edge of the upper plate portion 111 when forming the stopper portions 115, a distance from the front 111A of the upper plate portion 111 to a rear wall 111B of the stopper portion 115 is non-uniform along the length of the stopper portion. Hence, it is possible for the front plate 121 to become skewed relative to the outer casing during the assembly work, whereby gaps or clearance between the front plate and outer casing can easily occur. This complicates the assembly process and makes it difficult to locate various parts in a precise relationship to one another.

Also, during a transportation or operation of the microwave oven, the front plate is susceptible to being displaced relative to the outer casing by external forces to thereby degrade the appearance thereof as well as damage the internal electrical components and disconnect lead wires.

SUMMARY OF THE INVENTION

To solve the above problems, it is an object of the present invention to provide a microwave oven in which a mutual assembly position between an outer casing an a front plate of an inner casing can be exactly set, and a mutual clearance and deformation can be prevented, to thereby enhance an assembly capability and overall appearance.

To accomplish the above object of the present invention, there is provided a microwave oven comprising inner and outer casings. The inner casing forms a cooking chamber and includes front and rear plates. The front plate forms an access opening of the cooking chamber. An outer peripheral edge of the front plate includes a flange structure extending toward the rear plate. The outer casing is mounted on the inner casing and includes a front edge extending adjacent to the outer peripheral edge of the front plate and defining an opening in which the front plate is received such that the flange structure thereof extends along an inner surface of the outer casing. The outer and inner casings together form a stop structure positioning the inner and outer casings in a predetermined relationship.

Preferably, the stop structure comprises a plurality of stops formed in the outer casing. The stops are spaced by equal distances from the front edge and are abutted by the flange structure.

The outer casing preferably includes a bent strip structure forming a slit into which the flange structure is inserted. The stops are preferably of one piece with the strip and are situated on opposite sides of the slit. In another embodiment of the invention, the flange structure of the inner casing includes a pair of tabs formed by bent ends of the flange structure. The tabs engage opposite ends of the strip structure. The tabs and the opposite ends of the strip structure define the stop structure.

BRIEF DESCRIPTION OF THE DRAWINGS

The objects and advantages of the invention will become apparent from the following detailed description of preferred embodiments thereof in connection with the accompanying drawing in which like numerals designate like elements, and in which:

FIG. 8 is an exploded perspective view of a conventional microwave oven.

DETAILED DESCRIPTION OF PREFERRED EMBODIMENTS OF THE INVENTION

Figure 1:
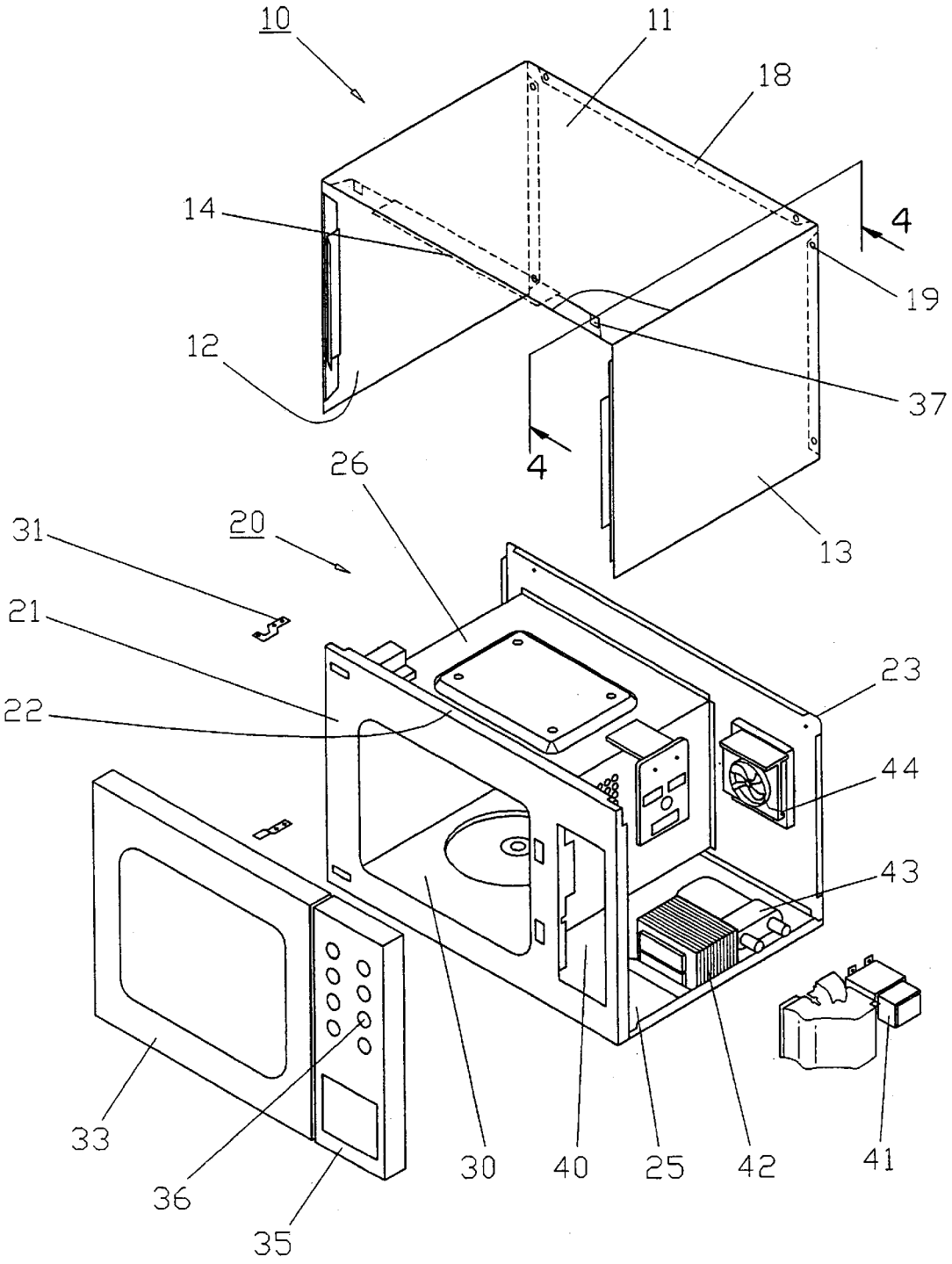
FIG. 1 is an exploded perspective view of a microwave oven according to a first embodiment of the present invention.
Figure 2:
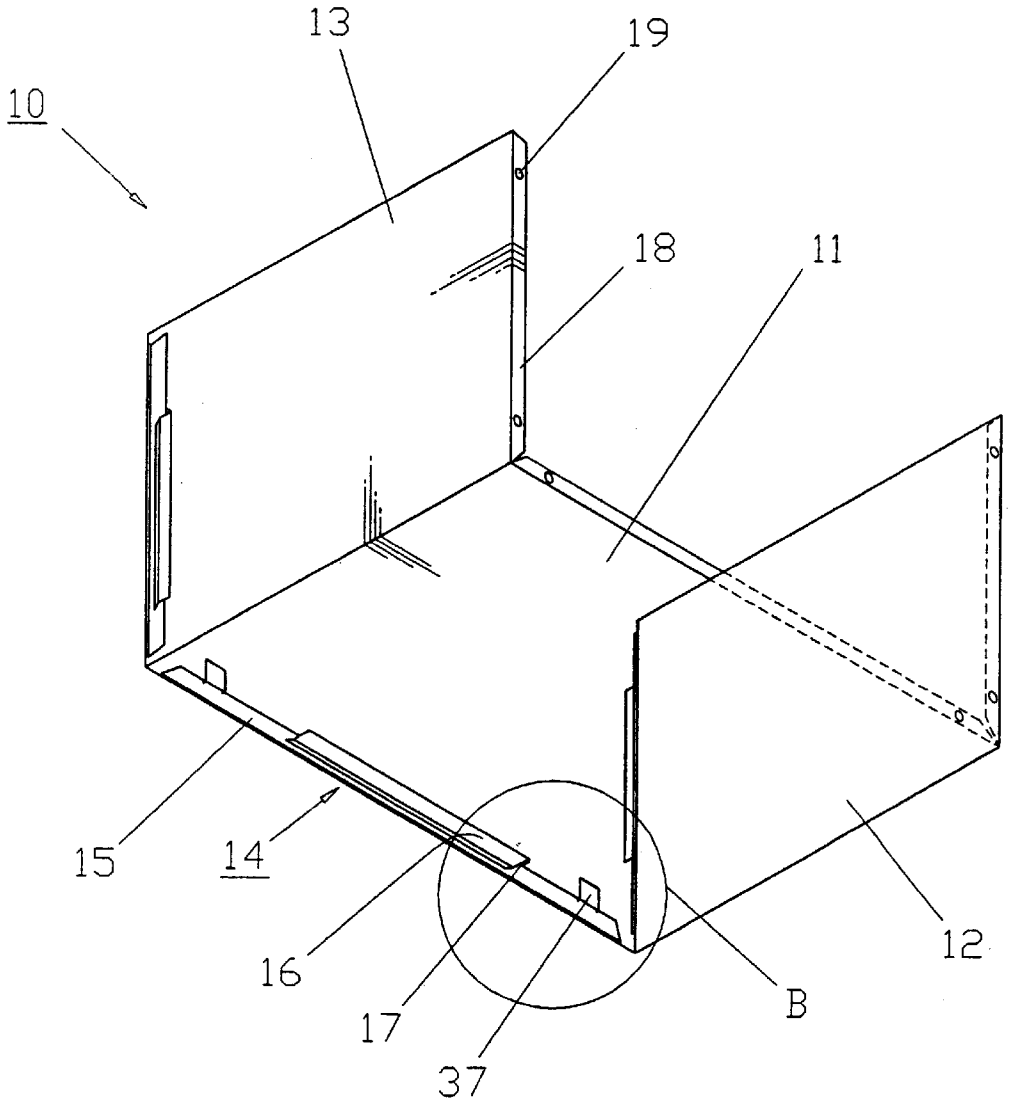
FIG. 2 is a reversed perspective view of the outer casing of FIG. 1.
Figure 3:
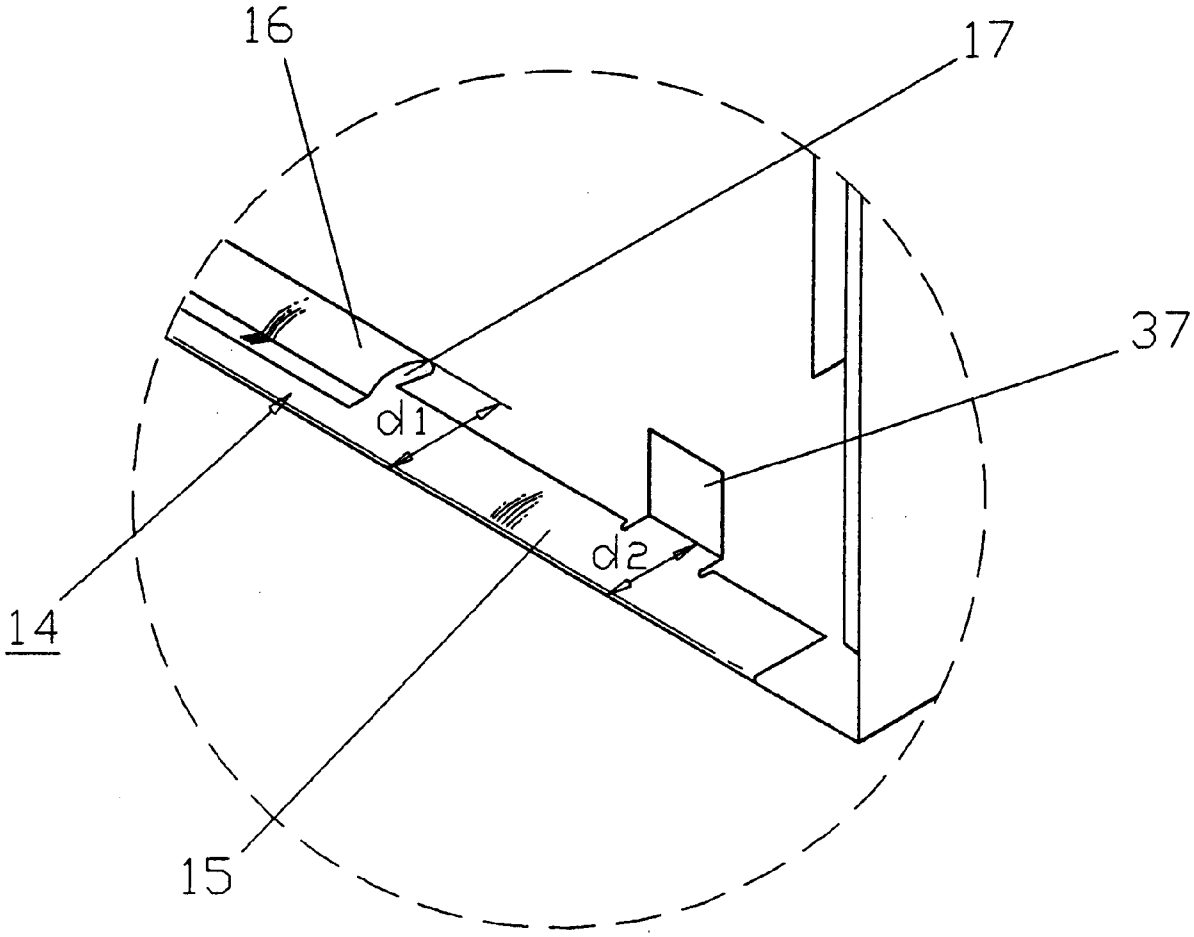
FIG. 3 is an enlarged perspective view of a portion "B" of FIG. 2.
Figure 4:
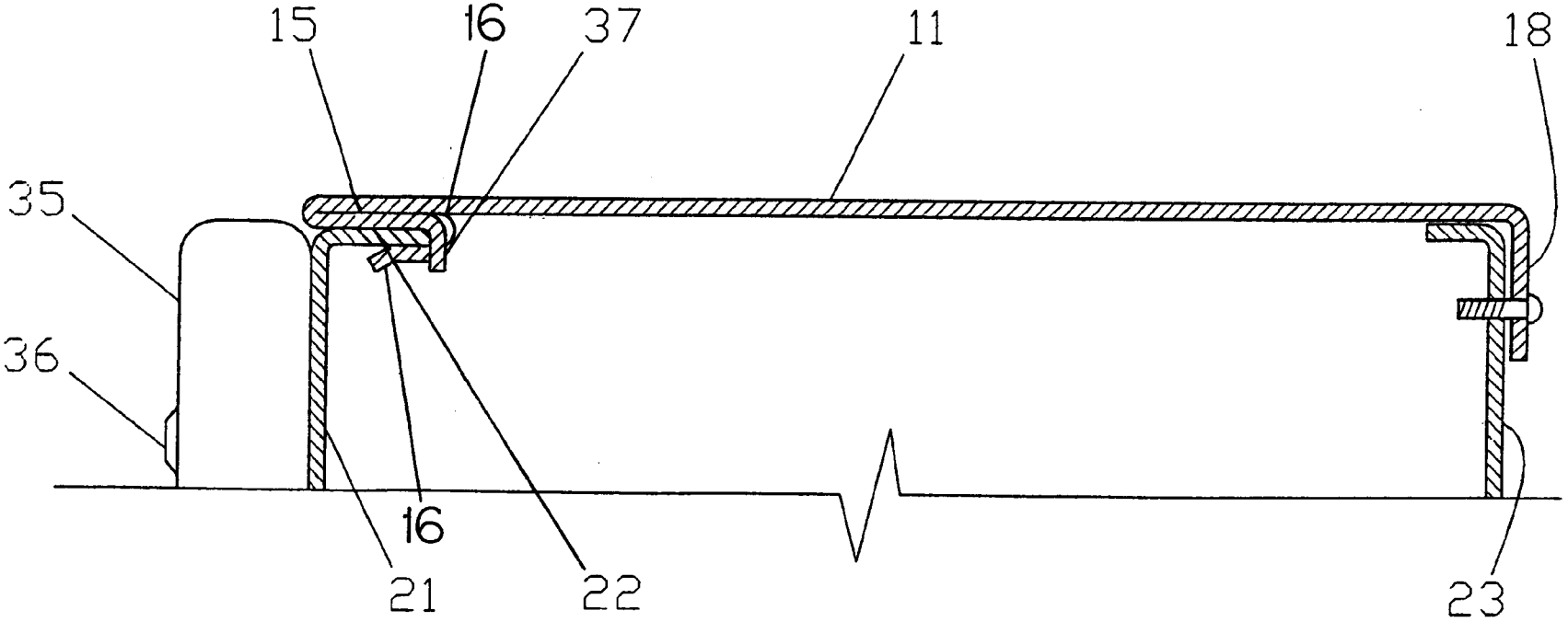
FIG. 4 is a sectional view of a connection state taken along the line 4—4 of FIG. 1.

Preferred embodiments of the present invention will be described with reference to the accompanying drawings.

Referring to FIGS. 1 through 4, a microwave oven includes an outer casing 10 defining an external appearance of the oven, and an inner casing 20 forming a cavity 30. In the outer casing 10, an upper plate 11 and two sidewall portions 12 and 13 are integrally formed in an inverted U-shaped form. The inner casing 20 has a front plate 21, a rear plate 23 and a bottom plate 25 which respectively form a front opening, a rear opening and a bottom opening.

The top and side edges of the front plate 121 include rearwardly bent flanges 22. The inner casing 20 includes a cavity casing 26 which is connected between the front plate 21 and the rear plate 23. Hinges 31 are connected with the left side of the front plate 21. A door 33 for rotatably opening and closing an access opening of the cooking chamber 30 is installed on the hinges. A control portion 35 having a plurality of manipulation buttons 36 for controlling the microwave oven is connected to the right side of the front plate 21.

A component chamber 40 is formed between the outer casing 10 and the cavity casing 26 of the inner casing 20. A magnetron 41, a high-voltage transformer 42 for inducing a high voltage, and a high-voltage capacitor 43 for applying a high voltage are installed in the component chamber 40. A cooling fan 44 for cooling heat-generating components is installed on the upper portion of the rear plate 23.

Screw connection holes (not shown) are formed along the external side edges of the rear plate 23. Rear edges of the plate portions 11, 12, 13 are defined by bent portions 18 which are bent perpendicular to the respective plate portion. A plurality of screw connection holes 19 are formed in the bent portions 18. The front edge of the outer casing 10 is bent to form Z-shaped strip portions to accommodate the corresponding front plate flange portions 22.

Each of the strips 14 includes a primary bent portion 15 which is bent backwards by a predetermined length substantially parallel with the respective plate surface, and a secondary bent portion 16 which is reversely (forwardly) bent. A forwardly open slit 17 is formed between the primary bent portion 15 and the secondary bent portion 16. A free end portion of the secondary bent portion 16 is inclined outwardly so that the front plate flange portion 22 is guided into the slit 17.

The primary bent portion 15 extends longitudinally past both ends of the secondary bent portion 16, and two rear stoppers 37 extend inwards from a rear edge of the primary bent portion 15, so as to straddle the secondary bent portion 16.

Each rear stopper 37 is formed so that a distance d2 from the front edge of the outer casing 10 to the rear stopper 37 is shorter than a depth d1 from the front edge of the outer casing 10 to the rear edge of the secondary bent portion 16, whereby the stoppers 37 limit an insertion depth of the flange portion 22 into the slit 17.

By the above construction, when the front plate flange portions 22 of the front plate 21 are inserted into the strip 14 to connect the front plate 21 to the outer casing 10, the rear stoppers 37 contact the rear edge of the respective flange portions 22 to limit the insertion depth and thereby determine an exact assembled relationship between the rear edge of the outer casing 10 and the rear plate 23 to facilitate assembly work, and also to prevent the front plate 21 from being pushed backwards and deformed by an external force.

Figure 5:
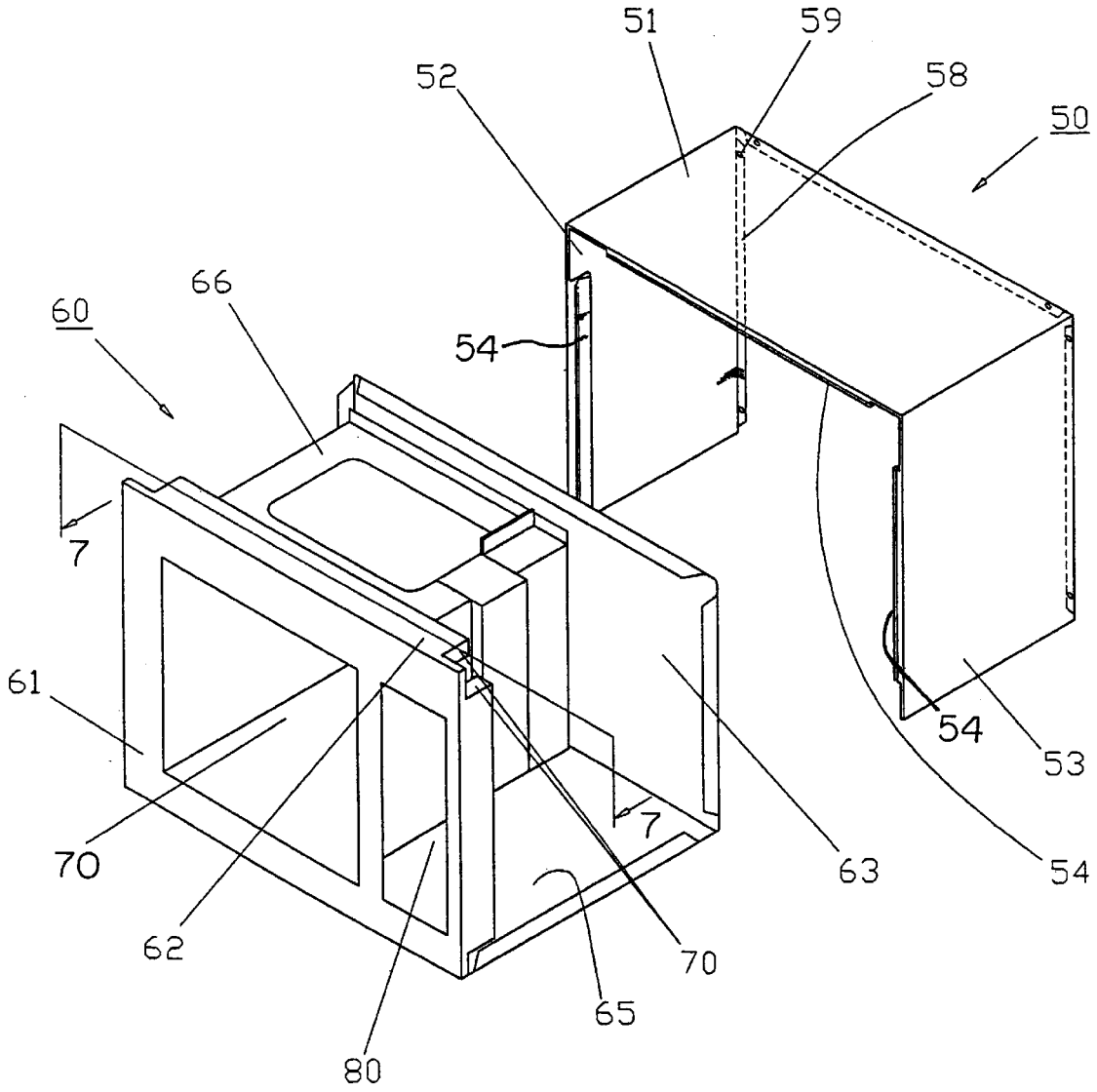
FIG. 5 is a schematic exploded perspective view of a microwave oven according to another embodiment of the present invention.
Figure 6:
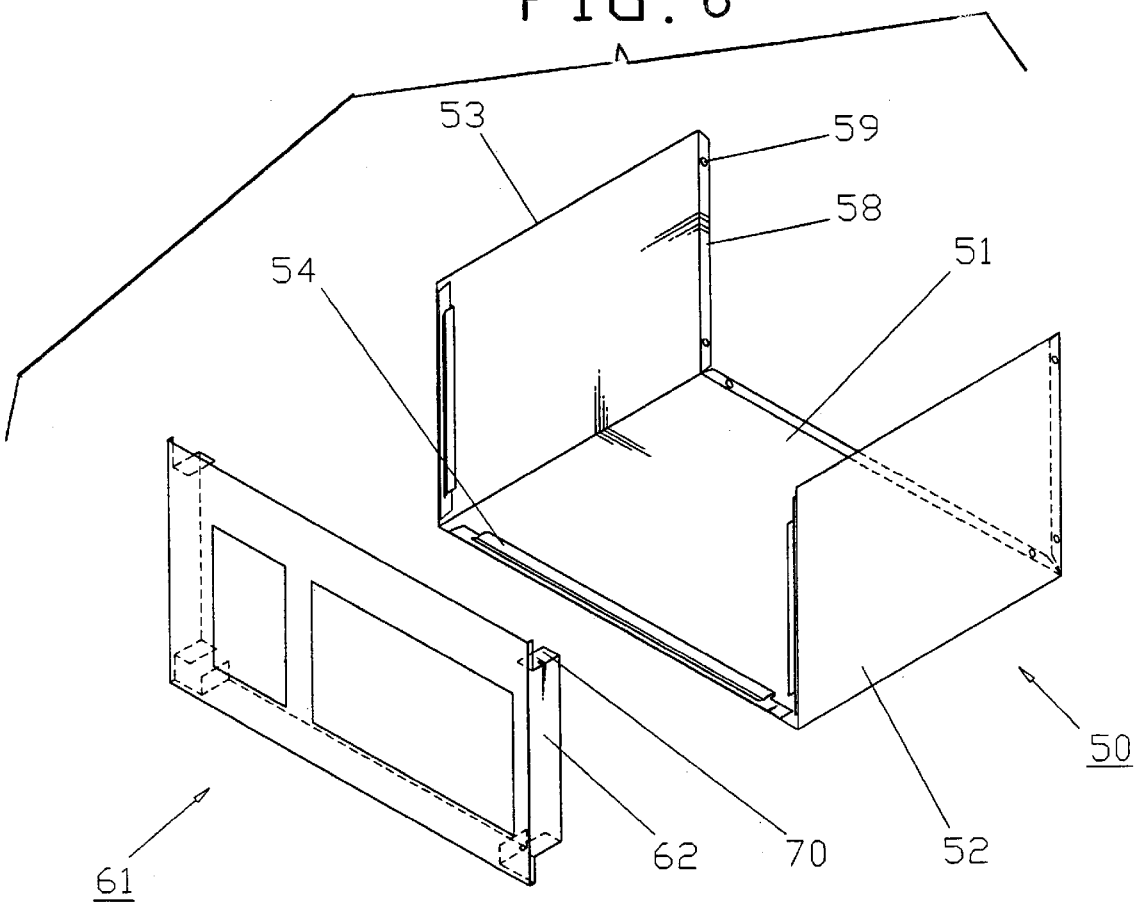
FIG. 6 is a reversed perspective view showing essential elements of the front plate and the outer casing of FIG. 5.
Figure 7:
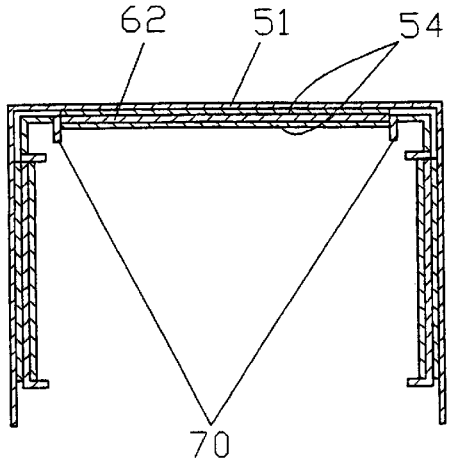
FIG. 7 is a sectional view of a connection state taken along the line 7—7 of FIG. 5.
Figure 8A:
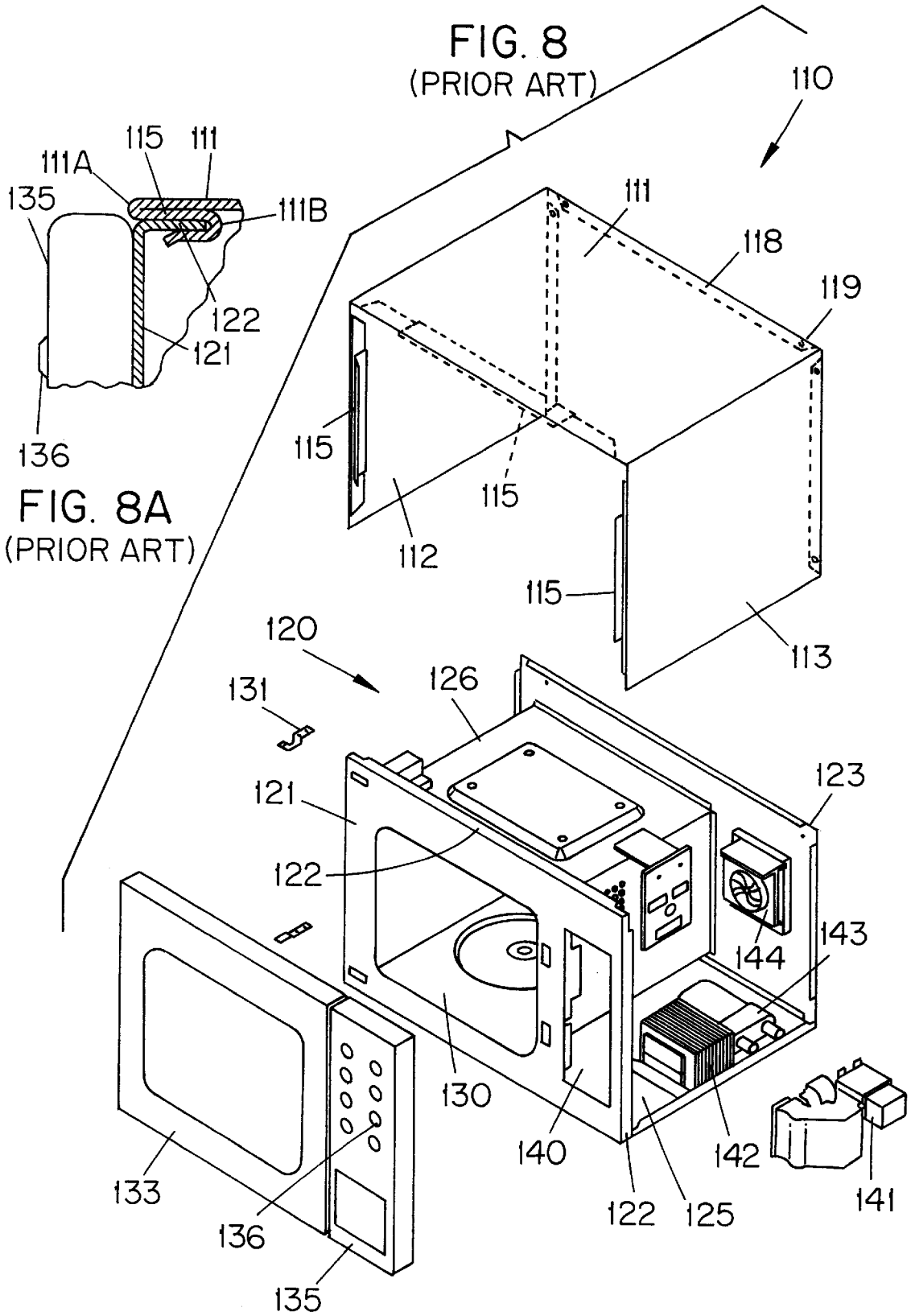
FIG. 8A (PRIOR ART)
FIG. 8A is a sectional view of a portion of the conventional oven of FIG. 8.

FIGS. 5–7 depict another embodiment of the present invention wherein a microwave oven includes an outer casing 50 forming an external appearance of the oven, and an inner casing 60 forming a cavity 71, as in the above-described embodiment with reference to FIGS. 1 through 4. In the outer casing 50, an upper plate 51 and sidewall portions 52 and 53 are integrally formed. Each of the upper and side edges of the front opening of the outer casing 50 is bent to form Z shaped strip portions 54. Also, the upper edge and both side edges of the rear opening of the outer casing 50 are bent to form inward flanges 58. A plurality of screw connection holes 59 are formed in the flanges 58. The inner casing 60 has a front plate 61, a rear plate 63 and a bottom plate 65 which respectively form a front opening, a rear opening and a bottom opening. The inner casing 60 also has a cavity casing 66 which is connected between the front plate 61 and the rear plate 63.

Meanwhile, front plate flange portions 62 extend from the upper edge and both side edges of the front plate 61 toward the rear plate 63. Lateral stoppers 70 constitute tabs formed by cutting the front flange portions 62 at locations where they intersect one another and bending inwards the thus-formed ends of the flange portions 62.

By the above construction, when the flange portions 62 of the front plate 61 are inserted into the Z-shaped strip portions 54 of the outer casing 50, the front plate 61 and the outer casing 50 are mutually engaged with each other. In this case, the lateral stoppers 70 of the front plate 61 oppose the ends of respective ones of the Z-shaped strip portions 54 of the outer casing 50, to thereby set an exact assembly position between the inner and outer casings with minimal clearance therebetween. Also, deformation of the front plate due to an external force generated during a transportation or operation of the microwave oven can be prevented.

As described above, in a microwave oven according to the present invention, a front plate flange portion which is extended from the edge of a front plate toward a rear plate of an inner casing is formed and a stopper portion for defining an assembly position of the front plate flange portion with respect to an outer casing is provided, to thereby exactly set a mutual assembly position between the inner casing and the outer casing, to enhance an assembly efficiency. Further, a mutual clearance and deformation between the front plate and the outer casing can be prevented, to enhance a reliability of products and a dignity of an appearance.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A microwave oven comprising:

an inner casing forming a cooking chamber and including front and rear plates, the front plate forming an access opening of the cooking chamber, an outer peripheral edge of the front plate including a flange structure extending toward the rear plate; and an outer casing mounted on the inner casing and including a front edge extending adjacent the outer peripheral edge of the front plate, the front edge defining an opening in which the front plate is received such that the flange structure thereof extends along an inner surface of the outer casing;

the outer and inner casings together forming a stop structure positioning the inner and outer casings in a predetermined relationship, the stop structure comprising a plurality of stops formed in the outer casing, the stops spaced by equal distances from the front edge and being abutted by the flange structure.

2. The microwave oven according to claim 1 wherein the outer casing further includes a bent strip structure forming a slit into which the flange structure is inserted.

3. The microwave oven according to claim 2 wherein the equal distances constitute equal first distances, the bent strip structure forming a wall located at a closed end of the slit, the wall spaced from the front edge by a second distance which is longer than the equal first distances.

4. The microwave oven according to claim 2 wherein the stops are of one-piece with the strip and situated on opposite sides of the slit.

5. A microwave oven comprising:

an inner casing forming a cooking chamber and including front and rear plates, the front plate forming an access opening of the cooking chamber, an outer peripheral edge of the front plate including a flange structure extending toward the rear plate; and an outer casing mounted on the inner casing and including a front edge extending adjacent the outer peripheral edge of the front plate, the front edge defining an opening in which the front plate is received such that the flange structure thereof extends along an inner surface of the outer casing; the outer and inner casings together forming a stop structure positioning the inner and outer casings in a predetermined relationship;

wherein the outer casing further includes a bent strip structure forming a slit into which the flange structure is inserted, the strip structure including opposite ends; the flange structure of the inner casing including a pair of tabs formed by bent ends of the flange structure, the tabs engaging the opposite ends of the strip structure, the tabs and opposite ends defining the stop structure.

* * * * *